United States Patent [19]

Diekmann

[11] Patent Number: 4,659,034

[45] Date of Patent: Apr. 21, 1987

[54] TOWED AIR TARGET

[75] Inventor: Franz Diekmann, Willich, Fed. Rep. of Germany

[73] Assignee: Rhein-Flugzeugbau GmbH, Moenchengladbach, Fed. Rep. of Germany

[21] Appl. No.: 669,262

[22] Filed: Nov. 7, 1984

[30] Foreign Application Priority Data

Nov. 17, 1983 [DE] Fed. Rep. of Germany ..... 3341549

[51] Int. Cl.[4] ..... F41J 9/08

[52] U.S. Cl. ..... 244/1 TD; 273/360; 273/372; 367/906

[58] Field of Search ..... 244/1 TD, 1 R; 273/360, 273/361, 372; 367/906, 117, 127

[56] References Cited

U.S. PATENT DOCUMENTS

| | | | |
|---|---|---|---|
| 2,448,587 | 9/1948 | Green | 273/372 |
| 4,323,993 | 4/1982 | Soderblom et al. | 273/372 |

FOREIGN PATENT DOCUMENTS

| | | | |
|---|---|---|---|
| 562468 | 12/1957 | Belgium | 273/372 |
| 2603061 | 8/1977 | Fed. Rep. of Germany | 273/360 |
| 1567491 | 5/1969 | France | 273/372 |

OTHER PUBLICATIONS

"Acoustic Miss Distance Indicator", LYTH Company publication, Aug. 1962.

*Primary Examiner*—Trygve M. Blix
*Assistant Examiner*—Rodney Corl
*Attorney, Agent, or Firm*—Ralf H. Siegemund

[57] ABSTRACT

A target bag to be towed has on its periphery arranged a plurality of pressure sensitive transducers for monitoring the trajectory of passing projectiles. The transducers are arranged to obtain overall omnidirectional response characteristics in relation to the center of the target.

3 Claims, 1 Drawing Figure

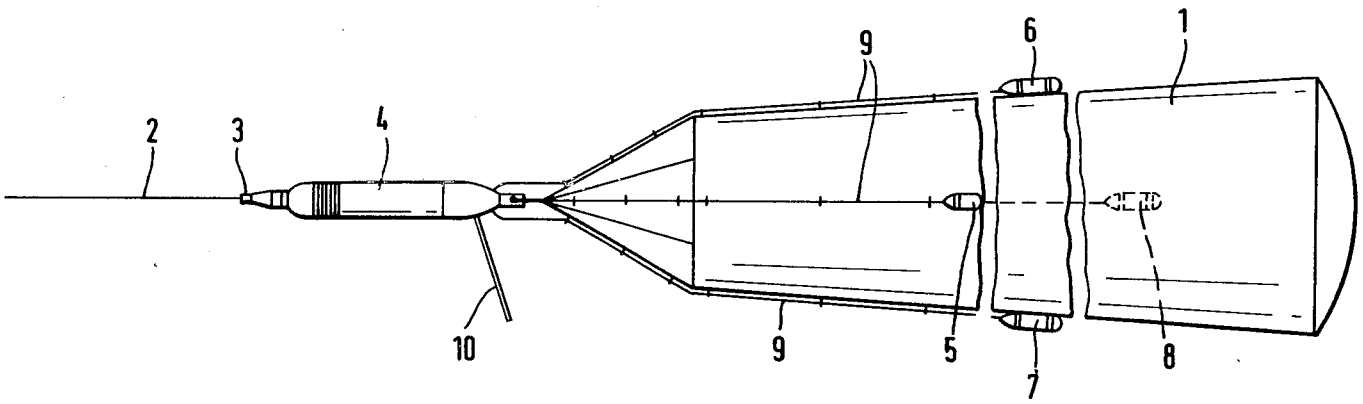
1
8
6
7
5
9
9
10
4
3
2

TOWED AIR TARGET

BACKGROUND OF THE INVENTION

The present invention relates to towed air target and including particularly a bag to be towed through a towing cable by an aircraft; the bag to be provided with metallic fibres for radar acquisition and further including a sound receiver which responds to compression or shock waves resulting from a passing projectile. The equipment further includes evaluating circuitry for ascertaining the trajectory of the projectile.

Devices of the kind to which the invention pertains are known generally. The towed bag serves as an optical target or a target to be detected through radar. The sound receiver is a pressure sensitive and measuring device responding to shock waves of passing projectiles, and the sound pattern can be used in order to acquire information about the trajectory of the projectile as it passes the target. The pressure or shock signals as detected are converted into electrical signals and through a signal line included in the towing cable these signals are transmitted to the towing craft to be evaluated by suitable electronic equipment on board of the craft. In practice, however, it was found that the acoustic "target" defined by the sound detector and the optical or radar target do not agree so that in relatively small distance ranges the measuring results are incorrect.

DESCRIPTION OF THE INVENTION

It is an object of the present invention to provide a new and improved device for permitting exact correlation between optical or radar target on one hand and sound or noise detection on the other hand in towed targets of the kind mentioned above.

It is a particular object of the present invention to provide a new and improved towed target device with a towing bag for optical and/or radar detection and further including a pressure sensitive device for acquiring shock waves from passing projectiles.

In accordance with the preferred embodiment of the present invention it is suggested to provide pressure sensitive transducer in the area of the target center of a towed bag and/or to provide at least two sensors on the outer periphery of the towed bag, being spaced on the periphery of the bag for symmetry whereby the sensors or transducers are sound receivers with a wide band response characteristics particularly a spherical (omnidirectional) characteristics which so to speak encloses the bag as seen from the center in all directions.

It can thus be seen that a spherical or omnidirectional response chararcteristic with a center that coincides with the center of the target, establishes the capability of acquiring indication of the trajectory of a passing projectile in relation to the center of the target, and this acquisition is quite independent from the direction and particular trajectory of the passing projectile in relation to the target bag and its sensor.

In furtherance of the invention more than two such pressure sensitive transducers are distributed around the periphery of the target bag and at least one sensor is longitudinally offset with respect to the other sensors under consideration of the fact that target bag itself is not spherical but has a longitudinal dimension, approximately coinciding with the direction of towing. This means that any passing projectile and the closest distance such a projectile has from the bag under consideration of time delays of the signals as acquired by the different sensors can still be more accurately determined. In addition one will not only be able too measure the distance of the closest approach of the projectile to the target but additional components of the trajectory in relation to the target center can be acquired. Thus additional information useful for target and shooting practice can be acquired so that the lead angle of the gun can be better defined and optimized.

It is further suggested to provide an on board transmitter for transmitting the sensor signals to be received via an antenna and receiver in a ground station or in the towing aircraft or both so that the signals can be suitably processed. In furtherance of the invention it is suggested to provide this transmitter in the front portion of the towed bag and suitable electrical connections connecting the pressure sensitive transducers to the transmitter and the towing cable is attached to the transmitter in the front portion through a swivel fastener.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which the FIGURE illustrates an example for the preferred embodiment of the present invention for practicing the best mode thereof.

Proceeding now to the detailed description of the drawings, the FIGURE illustrates a towed bag 1 which is connected through a towing cable 2 to an airplane which is not illustrated but is understood to be to the left of the illustration. The towing cable 2 is specifically connected to a transmitter 4 through a swivel fastener 3. The transmitter 4 in turn is connected to the front portion of the towed bag 1. The bulk of the towed bag is of conical configuration.

A plurality of pressure sensitive transducers 5,6,7, and 8 are particularly arranged around the periphery of the bag 1. Herein transducers 6 and 7 are disposed on diametrically opposite points. One can also say they are arranged on a circle around the axis of the bag 1 and the center of that circle is geometrically speaking the center of the target. The sensor 5 is offset by 90 degrees to each of these transducers 6 and 7 but is placed somewhat ahead axially of the center while the transducer 8 is 80 degrees offset to the transducer 7 or 180 degrees offset to transducer 5 but axially it is arranged somewhat behind the center defining circle on which the transducer 6 and 7 are located.

Each of these transducers 5,6,7, and 8 has a spherical or omnidirectional response characteristic or at least together they define an omnidirectional response characteristic which encloses the bag 1 in its entirety, and has the optical/radar center of the bag as the center for the response which, as stated, is the center of the circle on which the transducers 6 and 7 are situated.

The transmitter 4 is electrically connected by means of electrical cable 9 or signal lines to the transducers 5,6,7, and 8. The signals may, for example, be transmitted through a multiplex method using a common carrier or one can use several carrier frequencies. The transmitter 4, moreover, has an antenna 10 and the transmitted electrical signals are received either by the towing aircraft or a ground station or both. Moreover it is assumed that the bag 1 is provided with metal fibres to serve as a radar target.

In use, the bag 1 is towed through a target area and serves as target for shooting practice. The projectiles passing the bag produce shock waves which are received by the transducers 5,6,7, and 8. The amplitude of these shock waves is directly represented by the output signals of the transducers 5,6,7, and 8 and can be used as an indication for the closest distance the projectile passes in relation to the target center. In view of the spatial distribution of the sensors 5,6,7, and 8 one obtains a number of possible time differences in the shock wave arrival which permits an accurate reconstruction of the trajectory in relation to the target center. In toto this permits accurate tracking of the projectile for ascertaining the deviation from the contemplated or desired trajectory.

The invention is not limited to the embodiments described above but all changes and modifications thereof not constituting departures from the spirit and scope of the invention are intended to be included.

I claim:

1. Air target to be towed by an aircraft and including a bag further comprising:

a plurality of pressure sensitive transducers arranged on the bag in spaced apart relationship and including (i) a pair of transducers arranged on a circle of and on the periphery of the bag with the center coinciding with the center of the target, said transducers having a wide band spherical response characteristics such that a characteristic results which encloses the bag in its entirety; and at least one additional transducer on the target's periphery and being axially and azimuthally offset to the transducers of the pair.

2. Towed target as in claim 1 and further including a transmitter with an antenna, said transducers being electrically connected to said transmitter.

3. Towed target as in claim 2 said transmitter being arranged in the front portion of said bag and connected thereto, there being a towing cable connected to the front of the transmitter.

* * * * *